US006299506B2

(12) United States Patent
Nishimura et al.

(10) Patent No.: US 6,299,506 B2
(45) **Date of Patent: *Oct. 9, 2001**

(54) POLISHING APPARATUS INCLUDING HOLDER AND POLISHING HEAD WITH ROTATIONAL AXIS OF POLISHING HEAD OFFSET FROM ROTATIONAL AXIS OF HOLDER AND METHOD OF USING

(75) Inventors: Matsuomi Nishimura, Omiya; Osamu Ikeda, Yokohama; Satoshi Ohta, Tokyo; Shinzo Uchiyama, Utsunomiya, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 10 days.

(21) Appl. No.: 09/044,146

(22) Filed: Mar. 19, 1998

(30) Foreign Application Priority Data

Mar. 21, 1997 (JP) ..... 9-068160
Mar. 17, 1998 (JP) ..... 10-066856

(51) Int. Cl.[7] ..... B24B 49/02; B24B 7/04

(52) U.S. Cl. ..... 451/8; 451/41; 451/60; 451/271; 451/290

(58) Field of Search ..... 451/41, 60, 63, 451/270, 271, 285, 287, 290, 8

(56) References Cited

U.S. PATENT DOCUMENTS

| | | | | |
|---|---|---|---|---|
| 3,566,544 | | 3/1971 | Aspden . | |
| 3,676,960 | | 7/1972 | Aspden . | |
| 4,128,968 | | 12/1978 | Jones . | |
| 4,956,944 | | 9/1990 | Ando et al. . | |
| 5,105,583 | | 4/1992 | Hammond et al. . | |
| 5,531,635 | * | 7/1996 | Mogi et al. | 451/72 |
| 5,582,534 | | 12/1996 | Shendon et al. | 451/41 |
| 5,836,805 | * | 11/1998 | Obeng | 451/36 |
| 5,851,846 | * | 12/1998 | Matsui et al. | 451/17 |
| 5,860,847 | * | 1/1999 | Sakurai et al. | 451/10 |
| 5,860,851 | * | 1/1999 | Beppu et al. | 451/41 |
| 5,931,722 | | 8/1999 | Ohmi et al. | 451/271 |

FOREIGN PATENT DOCUMENTS

| | | | |
|---|---|---|---|
| 63-232932 | | 9/1988 | (JP) . |
| 1-170556 | * | 12/1989 | (JP) . |
| 5-285825 | | 11/1993 | (JP) . |
| 9-186117 | | 7/1997 | (JP) . |
| 9-277160 | | 10/1997 | (JP) . |

* cited by examiner

*Primary Examiner*—Timothy V. Eley
(74) *Attorney, Agent, or Firm*—Fitzpatrick, Cella, Harper & Scinto

(57) ABSTRACT

A polishing apparatus includes a holder for holding a polished body with a polished surface thereof facing upwardly, and a polishing head for holding a polishing pad having a polishing surface having an area smaller than an area of the polished surface while contacting the polishing pad with the polished surface and for rotating the polishing pad around its rotation axis. The polishing head is provided with a driver for revolving the polishing pad around a revolution axis, and the revolution axis and the rotation axis are positioned so that a distance between the revolution axis and the rotation axis becomes smaller than a radius of the polishing pad.

33 Claims, 7 Drawing Sheets

POLISHING APPARATUS INCLUDING HOLDER AND POLISHING HEAD WITH ROTATIONAL AXIS OF POLISHING HEAD OFFSET FROM ROTATIONAL AXIS OF HOLDER AND METHOD OF USING

BACKGROUND OF THE INVENTION

1. Field of the Invention

The present invention relates to a precise polishing apparatus and a precise polishing method for polishing a substrate such as a wafer with high accuracy.

2. Related Background Art

Recently, fine arrangement and multi-layer wiring of semi-conductor devices have progressed, and, thus, there is a need to provide precise polishing apparatuses for accurately flattening a surface of a semi-conductor wafer made of Si, GaAs, InP or SOI or a glass or quartz substrate (so-called element substrate) having a transistor. Among them, as a precise polishing apparatus for accurately flattening the surface of the substrate such as a wafer on which semi-conductor elements are formed, a chemical mechanical polishing (CMP) apparatus is known.

Conventional CMP apparatuses can be divided into two types shown in FIGS. 7 and 8.

(1) FIG. 7 is a schematic view of a polishing work portion of the CMP apparatus in which the polishing (abrasion) is effected with a polished surface of a wafer 100 facing downwardly.

As shown in FIG. 7, the wafer 100 is held with the polished surface (surface to be polished) thereof facing downwardly, and the wafer 100 is polished by urging the wafer against a polishing pad 502 having a diameter larger than that of the wafer while rotating the wafer. During the polishing, abrasive agent (slurry) is supplied onto the polishing pad 502.

In the apparatus of this kind, holding the wafer onto a wafer chuck 501 by using vacuum suction or adhesion by using wax, solution or pure water have been adopted. Additionally, in some cases a guide ring is provided on a periphery of the wafer 100 to prevent deviation of the wafer 100. The diameter of the polishing pad 502 on a polishing table 506 is greater than that of the wafer 100 by 3–5 times, and suspension obtained by mixing fine powder of silicon oxide with solution of potassium hydroxide is used as the slurry.

(2) On the other hand, as shown in FIG. 8, there has been proposed a technique in which a wafer 100 is held on a wafer chuck 601 having a guide ring and disposed on a wafer table 606 with a polished surface thereof facing upwardly and the wafer 100 is polished by using a polishing pad 602 having a diameter smaller than that of the wafer 100.

In such polishing apparatus and method, the substrate such as the present semi-conductor wafer having a diameter of eight inches can be polished exclusively. However, recently, since fine arrangement of semi-conductor integrated circuits and large diameter wafers have been proposed, it is guessed that the wafer having 8-inch diameter will be replaced by a wafer having 12-inch diameter in the near future.

However, in such conventional polishing apparatuses, although the polishing ability is adjusted by making a thickness and elasticity of the polishing pad optimum to polish the 8-inch wafer, in this case, it is difficult to ensure fine adjustment and uniformity of material of the polishing pad, and, thus, it is very difficult to polish the large diameter wafer such as a 12-inch wafer with high accuracy.

In order to solve the above problem, it is considered that the entire surface of the wafer is firstly polished by using a rough polishing pad, and, then, a desired portion of the wafer is polished selectively or preferentially to obtain a desired wafer surface.

However, in order to polish the large diameter wafer (having the diameter of 8 inch or more), there arises the following problem in the conventional techniques.

In the conventional polishing apparatuses and methods using a polishing tool greater than the wafer, a portion of the wafer which could not be made uniform is very hard to be made more uniform or be further flattened by using the same method. Further, in a system in which a polishing tool smaller than the wafer is used and scan is effected while oscillating the rotating polishing tool or in a system in which a polishing tool smaller than the wafer is used and scan is effected while revolving the rotating polishing tool within a radius range greater than a radius of the tool and oscillating the tool, although a desired portion of the wafer can be polished selectively or preferentially, pitch unevenness due to the scan is apt to be generated, and, it is difficult to correct such pitch unevenness with high accuracy and to make the wafer surface uniform and to flatten the wafer surface. Also in a system, as disclosed in U.S. Pat. No. 4,128,968, in which a rotating and revolving tool having a sectional configuration of the polishing becoming maximum around a revolution axis and gradually decreasing toward the periphery is used, although a desired portion of the wafer can be polished selectively or preferentially, pitch unevenness due to the scan is apt to be generated, and, it is difficult to correct such pitch unevenness with high accuracy and to make the wafer surface uniform and to flatten the wafer surface.

SUMMARY OF THE INVENTION

A first object of the present invention is to provide a polishing apparatus and a polishing method, in which a large area substrate can be corrected and polished with high accuracy.

A second object of the present invention is to provide a polishing apparatus and a polishing method, in which a desired portion of a wafer can be corrected selectively or preferentially with high accuracy by using a tool (polishing pad) smaller than the wafer to make the wafer more uniform and to further flatten the wafer.

To achieve the above objects, according to the present invention, there is provided a polishing apparatus comprising a holding means for holding a polished body with a polished surface thereof facing upwardly, and a polishing head for holding a polishing pad having a polishing surface having an area smaller than an area of the polished surface while contacting the polishing pad with the polished surface and for rotating the polishing pad around its rotation axis, and wherein the polishing head is provided with a drive means for revolving the polishing pad around a revolution axis, and the revolution axis and the rotation axis are positioned so that a distance between the revolution axis and the rotation axis is smaller than a radius of the polishing pad.

In the polishing apparatus, the holding means can be rotated.

In the polishing apparatus, the revolution axis of the polishing head can be shifted along the polished surface.

In the polishing apparatus, the revolution axis may be shifted to a predetermined position of the polished body in accordance with a surface configuration of the polished body.

In the polishing apparatus, the revolution axis of the polishing head may be shifted to a predetermined position of the polished body in accordance with a surface configuration of the polished body, by rotation of the holding means and by shifting movement of the revolution axis.

In the polishing apparatus, the polishing head may include a detection head for detecting the surface configuration of the polished body.

In the polishing apparatus, the polishing head may include a variable means for varying a distance between the revolution axis and the rotation axis.

In the polishing apparatus, the polishing head may have a supply passage for supplying abrasive agent through the polishing pad.

The present invention further provides a polishing method in which a polished body is rested on a holding means with a polished surface thereof facing upwardly and the polished surface is polished by rotating a polishing pad having a polishing surface having an area smaller than an area of the polished surface while contacting the polishing pad with the polished surface, comprising the steps of rotating the polishing pad around the rotation axis, and revolving the polishing pad around the revolution axis positioned so that a distance between the revolution axis and the rotation axis becomes smaller than a radius of the polishing pad.

The polishing method may further comprise a step of shifting the revolution axis to a predetermined position of the polished body in accordance with a surface configuration of the polished body.

The polishing method may further comprise a step of shifting the revolution axis of the head to a predetermined position of the polished body in accordance with a surface configuration of the polished body, by rotation of the holding means and by shifting movement of the revolution axis.

In the polishing method, a distance between the revolution axis and the rotation axis may be determined in accordance with a dimension of an element of the polished body which is an element substrate.

In the polishing method, the element substrate may be a semi-conductor wafer, a glass substrate or a quartz substrate.

In the polishing apparatus, the supply passage may pass through the rotation axis, and a supply tube for supplying abrasive agent which is disposed within the supply passage may be connected to an abrasive agent supply source for supplying the abrasive agent via a rotary joint.

In the polishing apparatus, the supply tube may pass through the revolution axis.

In the polishing method, the polished body may be polished while supplying the abrasive agent from a small hole formed in the polishing head for holding the polishing pad.

In the polishing method, a supply tube connected to the small hole may supply the abrasive agent from the small hole to the polished body.

In the polishing method, the supply tube may pass through the revolution axis.

DETAILED DESCRIPTION OF THE PREFERRED EMBODIMENTS

Figure 1:
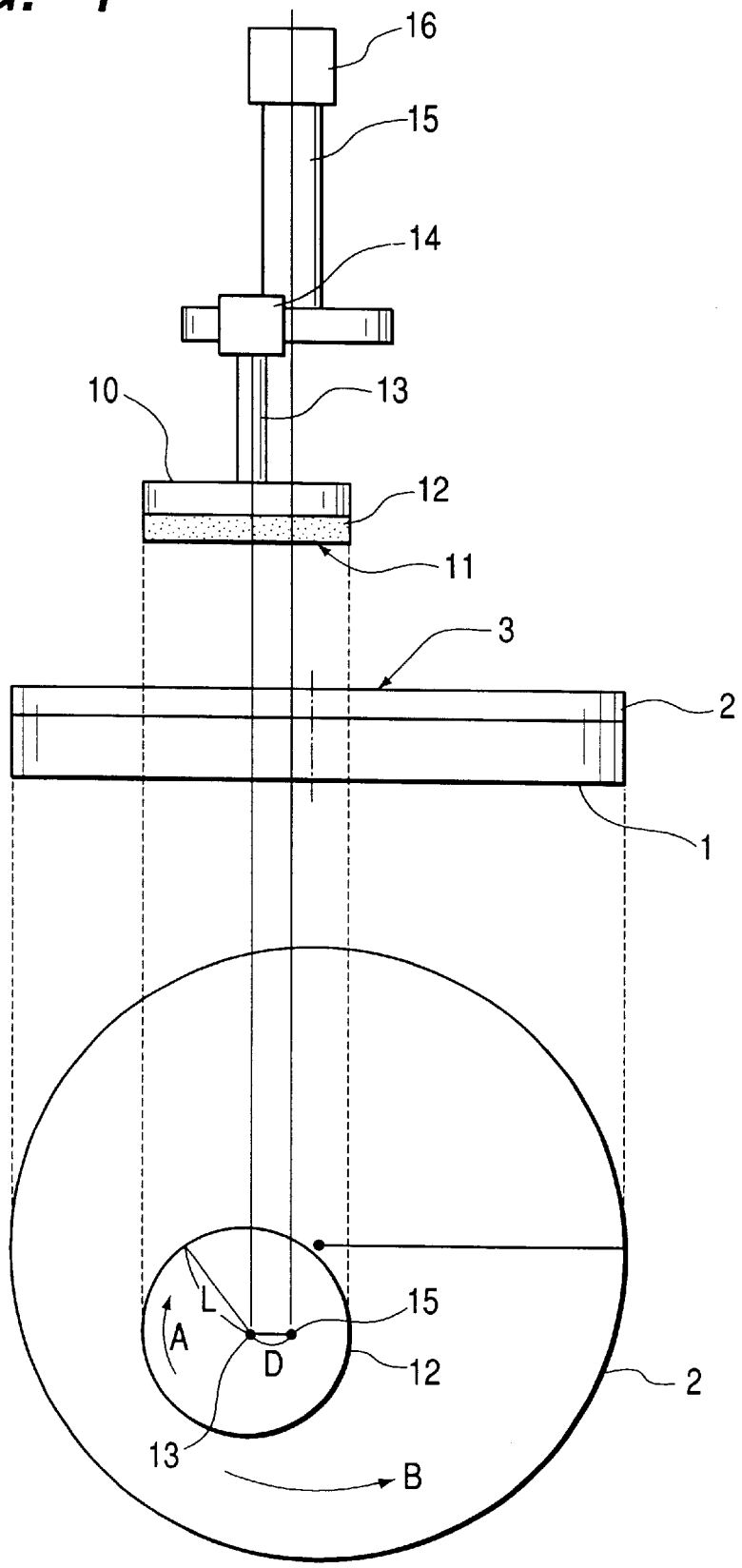
FIG. 1 is a schematic view for explaining the polishing apparatus and method according to a preferred embodiment of the present invention.

FIG. 1 is a schematic view for explaining the polishing apparatus and method according to a preferred embodiment of the present invention.

The reference numeral 1 denotes a holding means for holding a polished body 2 with a polished surface 3 thereof facing upwardly. A polishing head 10 serves to hold a polishing pad 12 having a polishing surface 11 having an area smaller than that of the polished surface 3 while contacting with the polished surface 3 and to rotate the polishing pad around a rotation axis 13.

The polishing head 10 is provided with a first drive means 14 for rotation, and a second drive means 16 for revolving the polishing pad 12 around a revolution axis 15, and the revolution axis 15 and the rotation axis 13 are positioned so that a distance D between the revolution axis 15 and the rotation axis 13 becomes smaller than a radius L of the polishing pad 12.

The polishing pad 12 is rotated around the axis 13 in a direction shown by the arrow A by rotating the polishing head 10 (to which the polishing pad is attached) around the rotation axis 13. At the same time, the polishing pad 12 is revolved around the axis 15 in a direction shown by the arrow B by rotating the polishing head 10 around the revolution axis 15.

Such a movement of the polishing pad is referred to as "orbital movement" hereinafter.

Figure 2:
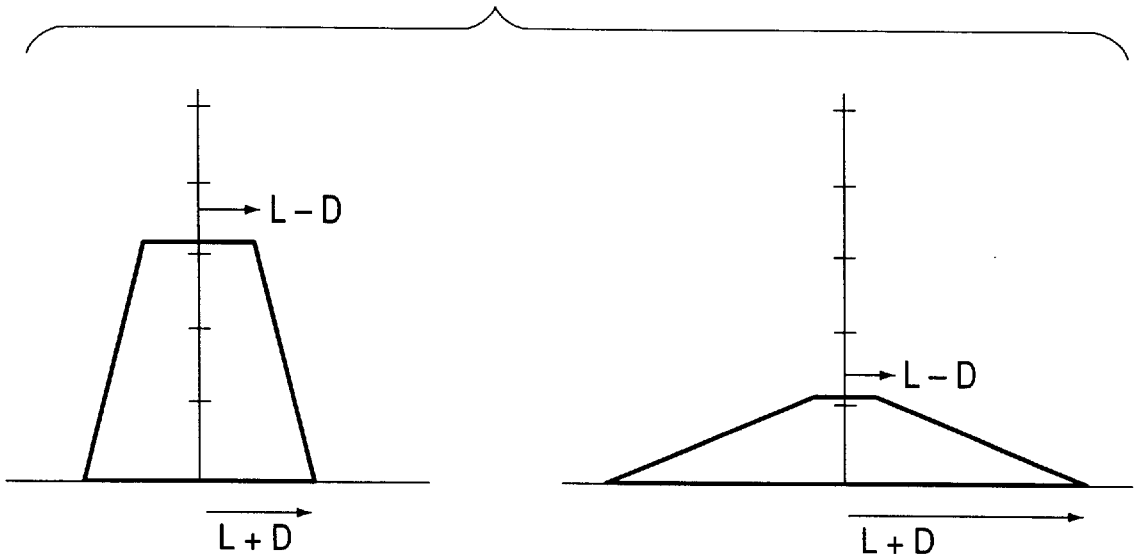
FIG. 2 is a schematic view showing a relation between a polishing rate and a position in an orbital movement.

FIG. 2 is a graph showing a polishing sectional configuration in the orbital movement. The ordinate indicates a polishing rate, and the abscissa indicates a position.

The sectional configuration of the polishing rate obtained by the polishing pad which effects the orbital movement becomes the maximum on the revolution axis when the number of rotations is the same as the number of revolutions, and the polishing rate is constant from the revolution axis to a predetermined position spaced apart from the revolution axis by a certain predetermined distance. The predetermined distance corresponds to a distance (L−D) obtained by subtracting the distance D (between the rotation axis and the revolution axis) from the radius L of the polishing pad. The polishing rate is decreased as the pad is moved away from the predetermined position. Thus, the sectional configuration of the polishing rate obtained by the polishing pad (polishing tool) which effects the orbital movement shows a trapezoid symmetrical with respect to the revolution axis. By using such a sectional configuration, an overlapping degree or extent due to scan and oscillation is made optimum, thereby obtaining a uniform flat polished surface having no scanning unevenness.

By changing the axis-to-axis distance D, a length of an upper side of the trapezoid can be changed, and, thus, the sectional configuration can be changed. In this case, however, although the polishing rate (height of the trapezoid) and a lower side of the trapezoid are also changed, by making the scan and the oscillation optimum by changing the sectional configuration appropriately, more accurate uniformity and flatness can be obtained.

Figure 3:
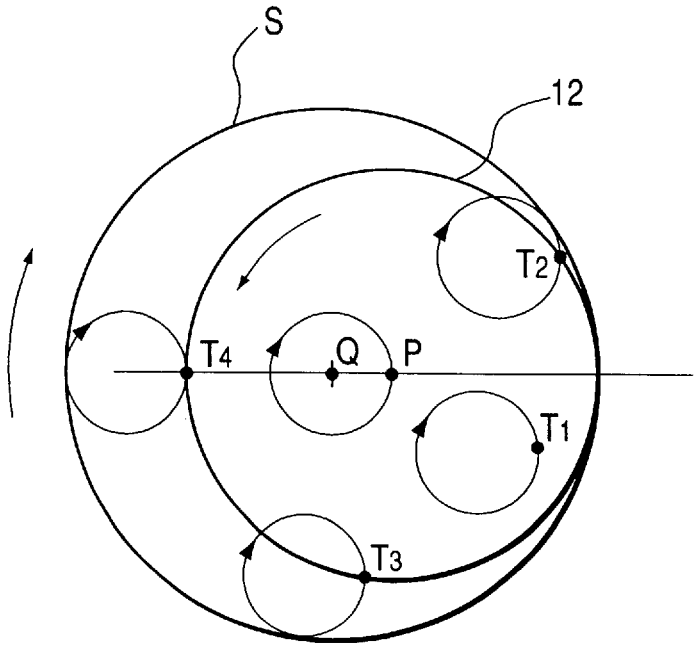
FIG. 3 is a view showing a locus of a polishing pad.

FIG. 3 is a view showing loci of five points on the polishing pad which effects the orbital movement.

In FIG. 3, the polishing pad 12 is rotated around a point P representing the rotation axis. Further, the polishing pad 12 is revolved around a point Q representing the revolution axis. In this case, a locus of revolution of the periphery of the polishing pad 12 is shown by the line S. A direction of the rotation and a direction of the revolution of the polishing pad 12 are opposite to each other. In this case, a point $T_1$ on an inner surface of the polishing pad describes a circular locus (as shown by the arrow) in the revolution direction. Similarly, points $T_2$, $T_3$ and $T_4$ on the periphery of the polishing pad 12 describe circular loci (as shown by the arrows) in the revolution direction. Further, the circular loci of the points $T_2$, $T_3$ and $T_4$ contact with the revolution locus S.

In this way, any point on the polishing pad 12 effects a circular movement as shown by the circular locus. The polishing pad 12 can polish the polished body (wafer) flatly at a circular zone (not shown) disposed around the point Q (representing the revolution axis) and having a radius corresponding to a distance obtained by subtracting a distance between the points P and Q from the radius of the polishing pad 12.

There are two kinds of polished bodies, i.e., a polished body in which an entire surface is to be polished to obtain a desired surface configuration, and a polished body in which only a part of the entire surface is to be polished to obtain a desired surface configuration. The present invention provides a polishing method particularly suitable for the latter. Thus, in the present invention, the polishing pad 12 is rested on a desired position on the polished body, and the polishing is effected at that position by using the orbital movement of the polishing pad. When a plurality portions are polished selectively, after the polishing pad 12 is shifted to one of the portions, the polishing is effected, and this operation is repeated.

Figure 4:
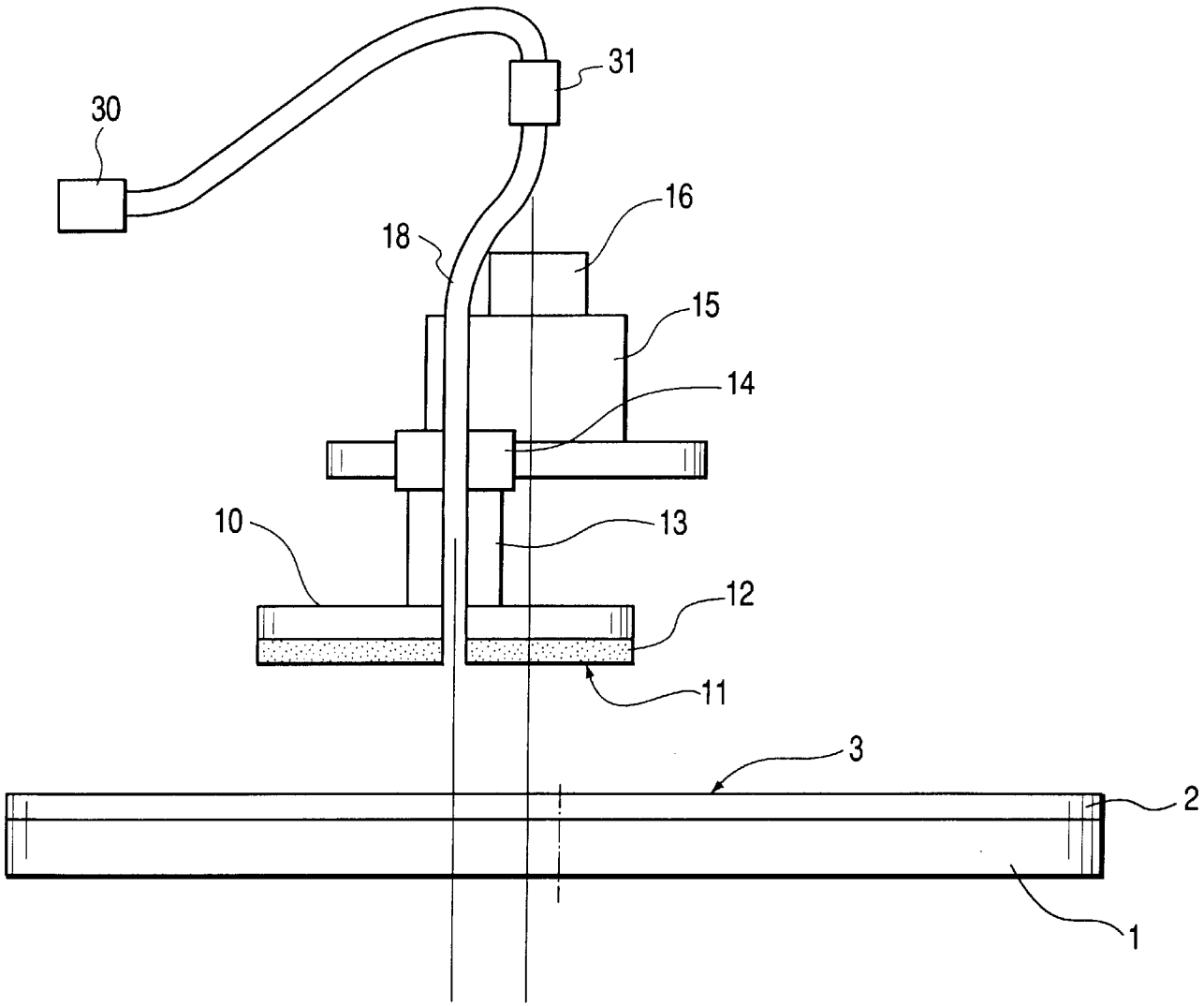
FIG. 4 is a schematic view showing a polishing apparatus according to another embodiment of the present invention.

Further, as shown in FIG. 4, an abrasive supply tube 18 disposed within a rotation shaft (rotation axis) 13 may extend through a revolution shaft (revolution axis) 15. As shown in FIG. 4, the supply tube 18 is connected to an abrasive supplying source 30 via a rotary joint 31. The first drive means 14 comprises a hollow motor, and the supply tube 18 is disposed within a hollow portion of the hollow motor. With this arrangement, since the supply tube 18 is connected to the abrasive supplying source 30 via the rotary joint 31, the supply tube 18 can be prevented from being twisted by the rotation of the polishing head 10, thereby preventing the damage of the supply tube. Further, since the supply tube 18 extends through the revolution shaft 15, the drive means for the polishing head can be made compact, and, accordingly, the entire polishing apparatus can be made compact.

(First Embodiment)

Figure 5:
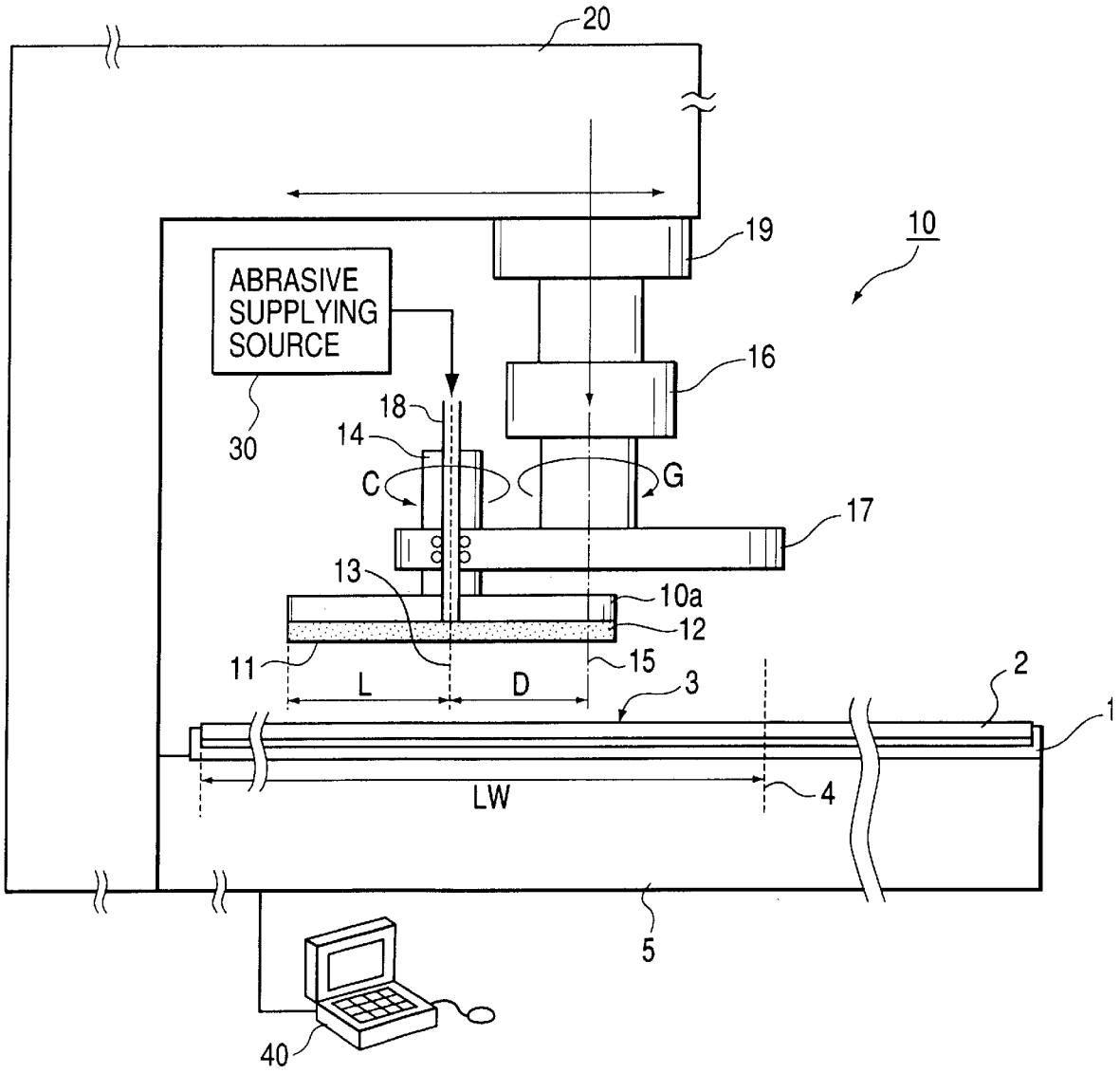
FIG. 5 is a schematic view showing a polishing apparatus according to a further embodiment of the present invention.

FIG. 5 is a schematic view for explaining a polishing apparatus and a polishing method according to a first embodiment of the present invention.

A circular wafer (polished body) 2 is rested on a wafer chuck (holding means) 1. The wafer chuck 1 can be rotated around a center line 4 of the wafer and is supported by a support 5. The support 5 is provided with a motor (not shown).

A polishing head 10 and associated parts are constituted as follows. That is to say, a polishing pad 12 is attached to a platen 10*a* with a polishing surface thereof facing downwardly. The platen 10*a* is rotated around the axis 13 in a direction shown by the arrow C by a motor (first drive means) 14. The rotation axis 13 is defined by a hollow abrasive supply tube 18. The motor 14 and the abrasive supply tube 18 are attached to a revolution table 17, and the revolution table 17 is rotated around the axis 15 in a direction shown by the arrow G by a motor (second drive means) 16. The motor 14 is a core-less motor through which the axis passes, i.e., a hollow motor. Abrasive is supplied from an abrasive supplying source 30 through the supply tube 18 to a rear surface of the polishing pad 12 and is sent toward a polishing surface 11 (of the polishing pad) through small holes formed in the polishing pad 12 or communication foams in the polishing pad itself. A pressurizing means 19 serves to urge the polishing pad 12 against the wafer or to separate the polishing pad 12 (contacted with the wafer 2) from the wafer 2.

A post 20 has a function for shifting the polishing head 10 along the upper surface of the wafer 2 and a function for supporting the polishing head 10.

In this polishing apparatus, the rotation axis 13 and the revolution axis 15 are positioned so that the radius L of the polishing pad 12 becomes greater than the distance D between the rotation axis 13 and the revolution axis 15 (L>D).

Next, a polishing method effected by using this polishing apparatus will be explained.

First of all, the wafer 2 is rested on the wafer chuck 1 with the polished surface (on which elements such as transistors are formed) facing upwardly and is secured to the chuck by vacuum suction.

The polishing pad 12 is adhered to the lower surface of the platen 10*a* with the polishing surface 11 thereof facing downwardly.

Mixture of abrasive particles and dispersing medium is loaded within the abrasive supplying source (tank) 30.

A drive control device 40 of the polishing apparatus is driven to operate the polishing apparatus. On the basis of surface configuration data inputted to the drive control device 40, the wafer chuck 1 is rotated and the head 10 is shifted along the surface of the wafer, thereby positioning the polishing pad 12 at a position opposed to a portion (to be polished) of the wafer.

The abrasive agent is supplied onto the surface of the wafer from the abrasive supplying source 30 through the polishing pad 12.

The platen 10*a* is rotated in the direction C and is revolved in the direction G.

The polishing head 10 is lowered to urge the polishing pad 12 against the wafer, thereby effecting the polishing with predetermined pressure.

After the polishing is continued for a predetermined time period, the head 10 is lifted. Thereafter, if another part is desired to be polished, the positioning of the part to be polished is performed by rotating the wafer 1 and shifting the head along a radial direction of the wafer, and then, the polishing is effected by repeating the above-mentioned processes. If there is no part to be further polished, the rotation, revolution and supply of the abrasive are stopped, thereby finishing the polishing operation.

(Second Embodiment)

Figure 6:
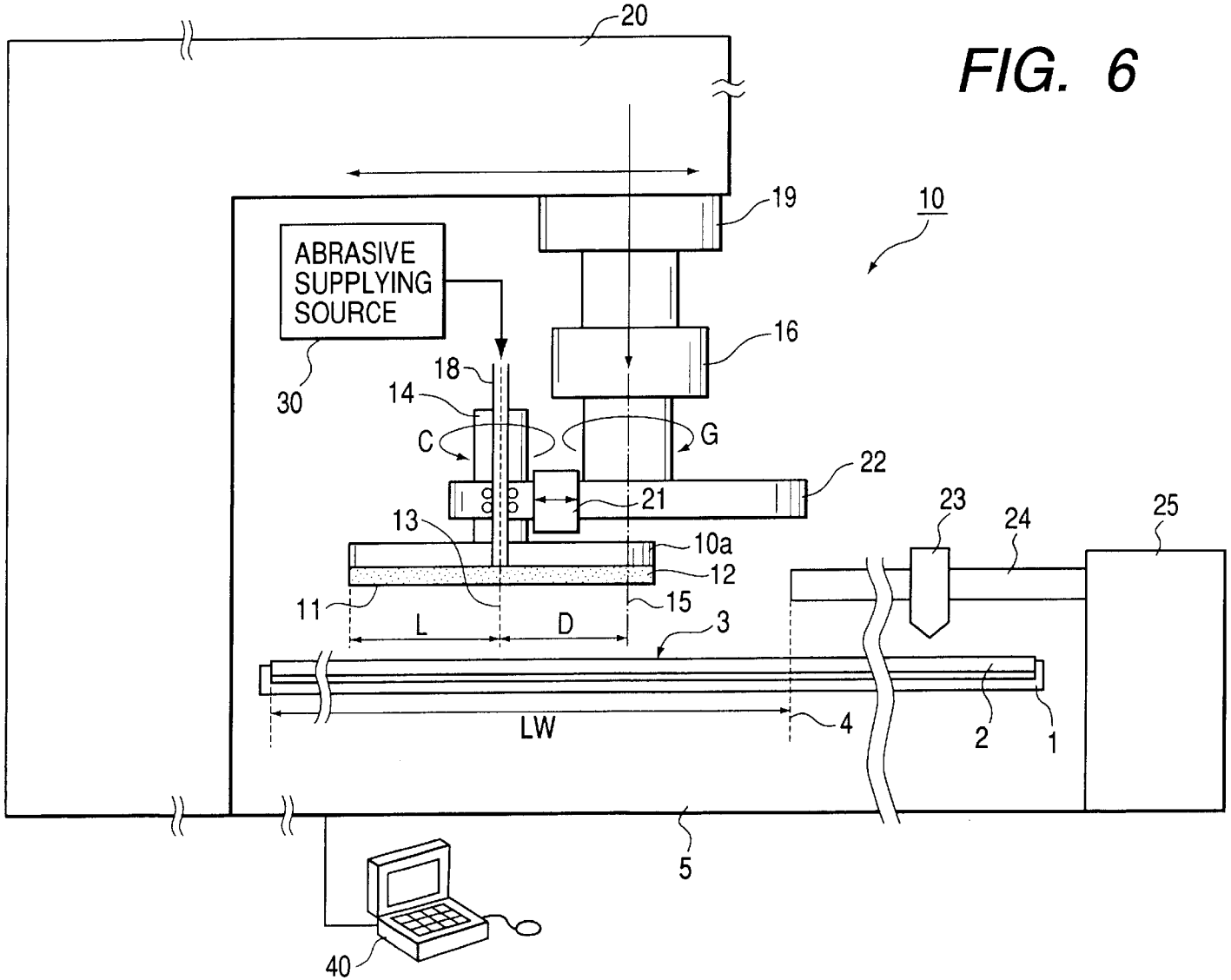
FIG. 6 is a schematic view showing a polishing apparatus according to a still further embodiment of the present invention.
Figure 7:
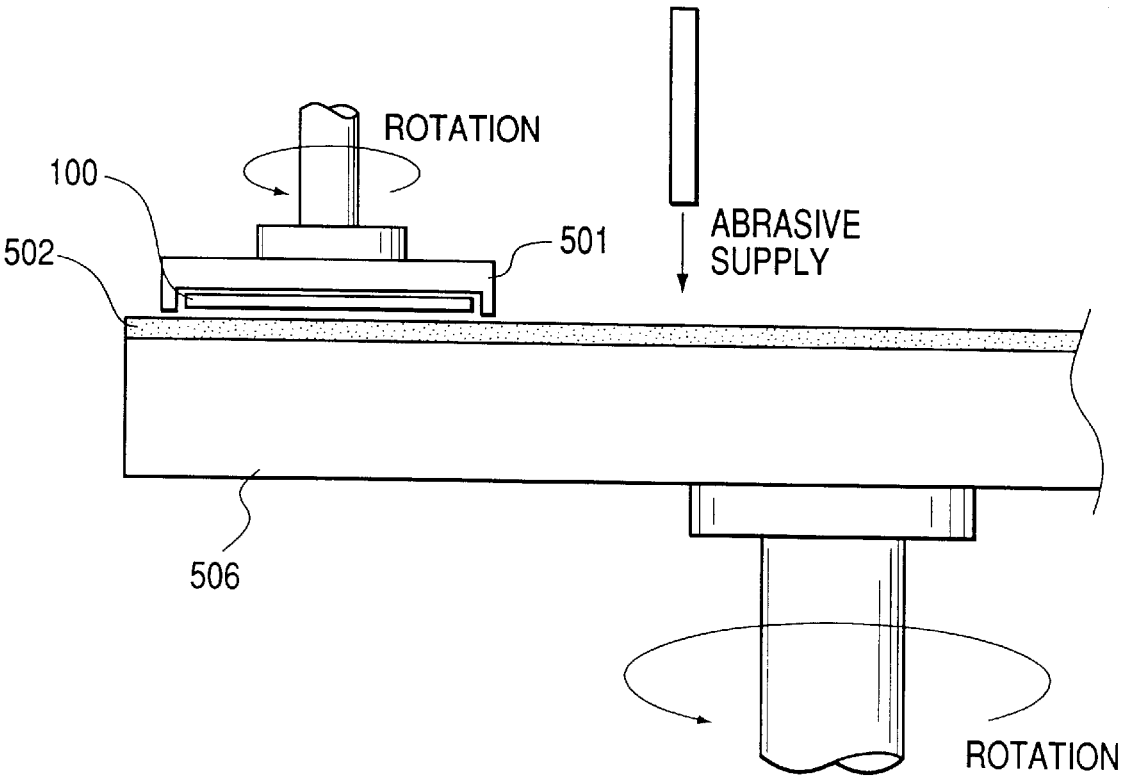
FIG. 7 is a schematic view showing a conventional polishing apparatus.
Figure 8:
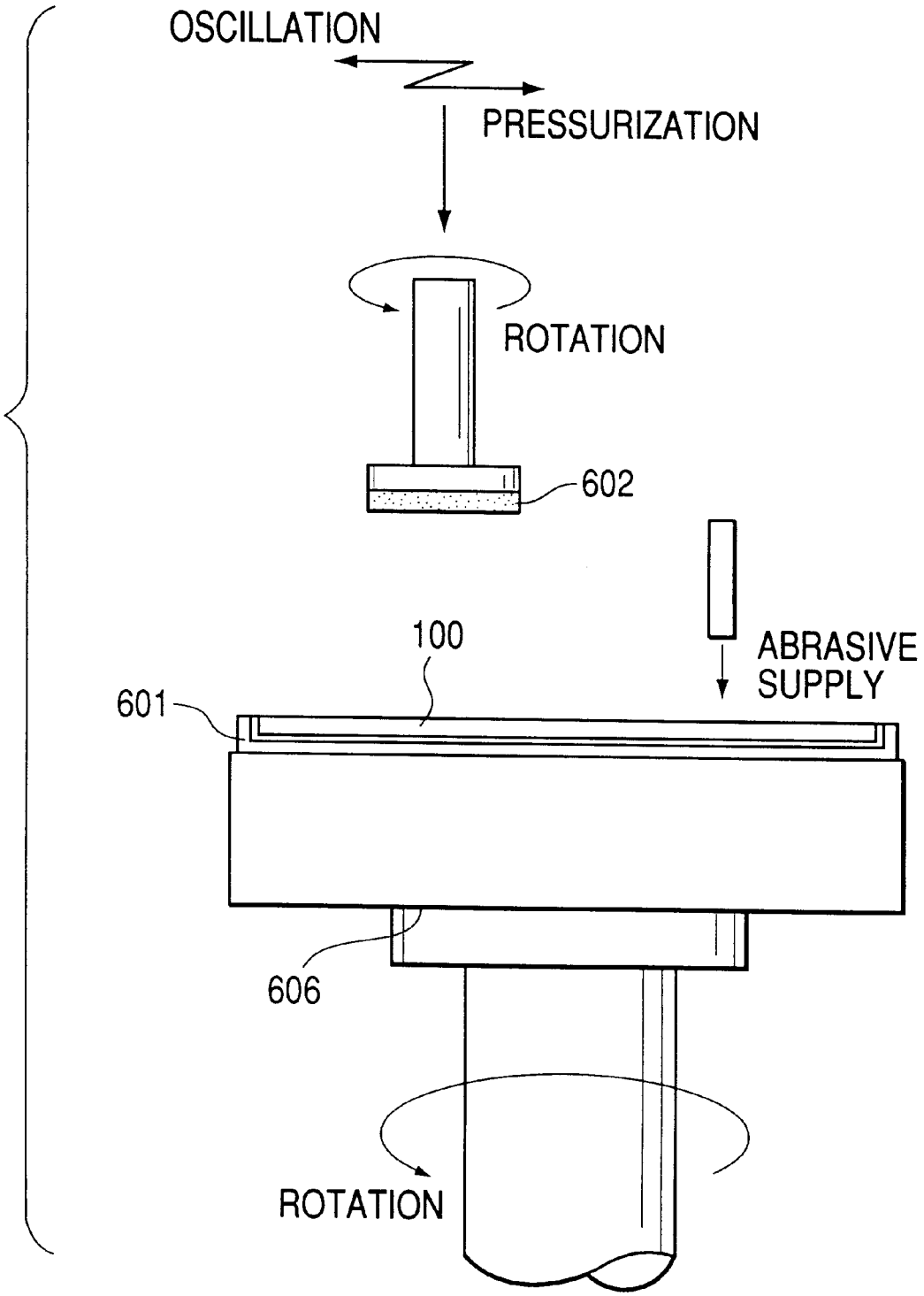
FIG. 8 is a schematic view showing another conventional polishing apparatus.

FIG. 6 shows a general purpose polishing apparatus according to a second embodiment of the present invention.

The second embodiment differs from the first embodiment in the point that there is provided a variable means for changing the distance D between the rotation axis 13 and the revolution axis 15 to polish the wafer more precisely in accordance with the kind of wafers. Further, a detection head for detecting the surface configuration to effect the positioning correctly in the polishing operation may be provided for shifting movement in a radial direction of the wafer 1.

The platen 10*a,* motor 14 and supply tube 18 are attached to a collapsible arm (variable means) 22 having a joint 21. The joint 21 can be operated manually or by a drive means (not shown) to adjust the distance D. A limiter may be provided so that the distance D does not exceed the radius L of the polishing pad 12 or the platen 10*a* when the distance D is determined.

The detection head 23, if provided, comprises a photosensor and is supported by a head guide 24 for shifting movement in a radial direction of the wafer chuck 1. The guide 24 is secured to a post 25. A range of the radial shifting movement of the detection head 23 is defined between a center line 4 of the wafer chuck and a radial end of the wafer chuck. The drive control device 40 judges where the detected surface condition is situated on the wafer on the basis of the rotation amount and the radial shifting amount of the wafer. After the correction polishing is effected by the polishing head 10, the surface configuration of the polished portion is detected again by the detection head 23. If it is judged that such configuration is not desired, the same portion is polished again.

The other constructions are the same as those in the first embodiment.

Next, a polishing method effected by using this polishing apparatus will be explained.

First of all, the wafer 2 is rested on the wafer chuck 1 with the polished surface (on which elements such as transistors are formed) facing upwardly and is secured to the chuck by vacuum suction.

In accordance with sizes of IC chips or sizes of semiconductor elements formed on the wafer 2 to be polished, a size of the polishing pad 12 is selected. For example, regarding an 8-inch wafer, when the size of a microprocessor chip to be formed is 10 mm×10 mm, a circular or rectangular polyurethane pad having a dimension greater than the size of the chip from by several times to by one-several numbers time may be used as the polishing pad 12. The polishing pad 12 is adhered to the lower surface of the platen 10*a* with the polishing surface thereof facing downwardly.

The distance D is a desired value which does not exceed the radius L of the pad by adjusting the joint 21.

A mixture of abrasive particles and dispersing medium is loaded within the abrasive supplying source (tank) 30.

The drive control device 40 of the polishing apparatus is driven to operate the polishing apparatus.

In the illustrated embodiment, the surface configuration of the wafer 2 is detected by using the detection head 23. On the basis of the data regarding the surface configuration inputted from the detection head 23 to the drive control device 40, the wafer chuck 1 is rotated and the head 10 is shifted along the surface of the wafer, thereby positioning the polishing pad 12 at a position opposed to a portion (to be polished) of the wafer.

The abrasive agent is supplied onto the surface of the wafer from the abrasive supplying source 30 through the polishing pad 12.

The platen 10*a* is rotated in the direction C and is revolved in the direction G.

The ration between the number of rotations and the number of revolutions is preferably 1 or one-several numbers time or several times to obtain a good result.

The polishing head 10 is lowered to urge the polishing pad 12 against the wafer, thereby effecting the polishing with predetermined pressure.

After the polishing is continued for a predetermined time period, the head 10 is lifted. Thereafter, if another part is desired to be polished, the positioning of the part to be polished is performed by rotating the wafer 1 and shifting the head along a radial direction of the wafer, and then, the polishing is effected by repeating the above-mentioned processes. If there is no part to be further polished, the surface configuration is detected again by the detection head 23. In this case, if the detected surface configuration is desirable, the rotation, revolution and supply of the abrasive are stopped, thereby finishing the correction polishing operation. According to the illustrated embodiment, since the distance between the rotation axis and the revolution axis can be changed, even any element substrates having different IC chip size, transistor size or wiring rule, the substrate can be polished flatly with high accuracy along undulation of the element substrate.

According to the present invention, the configuration of the desired part of the polished body can selectively or preferentially be correction-polished with high accuracy.

What is claimed is:

1. A polishing apparatus comprising:

holding means for holding a polished body with a polished surface thereof facing upwardly; and a polishing head for holding a polishing pad having a polishing surface of an area smaller than an area of the polished surface to be contacted with said polishing pad and for rotating said polishing pad around its rotation axis, wherein said polishing head is provided with drive means for revolving said polishing pad around a revolution axis, with the revolution axis and the rotation axis positioned so that a distance between the revolution axis and the rotation axis is smaller than a radius of said polishing pad.

2. A polishing apparatus according to claim 1, wherein said holding means can be rotated.

3. A polishing apparatus according to claim 1, wherein the revolution axis of said polishing head can be shifted along the polished surface.

4. A polishing apparatus according to claim 1, wherein the revolution axis is shifted to a predetermined position of the polished body in accordance with a surface configuration of the polished body.

5. A polishing apparatus according to claim 1, wherein the revolution axis of said polishing head is shifted to a predetermined position of the polished body in accordance with a surface configuration of the polished body, by rotation of said holding means and by shifting movement of the revolution axis.

6. A polishing apparatus according to claim 1, wherein said polishing head includes a detection head for detecting a surface configuration of the polished body.

7. A polishing apparatus according to claim 1, wherein said polishing head includes means for varying a distance between the revolution axis and the rotation axis.

8. A polishing apparatus according to claim 1, wherein said polishing head h as a supply passage for supplying abrasive agent through said polishing pad.

9. A polishing apparatus according to claim 1, wherein said polishing head includes a detection head for detecting a surface configuration of a polished portion of the polished body.

10. A polishing apparatus according to claim 1, wherein said revolution axis of said polishing head can be shifted along the surface of the wafer.

11. A polishing apparatus according to claim 1, further comprising a detector for detecting a surface configuration of the wafer.

12. A polishing apparatus according to claim 1, wherein a distance between said revolution axis and said rotation axis is variable.

13. A polishing apparatus according to claim 1, wherein said polishing head has a supply passage for supplying abrasive agent through said polishing pad.

14. A polishing apparatus according to claim 1, wherein the wafer has a semiconductor element.

15. A polishing apparatus according to claim 1, wherein a desired part of the surface of the wafer is selectively or preferentially polished.

16. A polishing method in which a polished body is secured on holding means with a polished surface thereof facing upwardly and the polished surface is polished by rotating a polishing pad having a polishing surface with an area smaller than an area of the polished surface, comprising the steps of:

rotating the polishing pad around a rotation axis;

revolving the polishing pad around a revolution axis positioned such that the rotation axis and the revolution axis are spaced apart from each other; and arranging the polishing pad so that a distance between the revolution axis and the rotation axis is smaller than a radius of the polishing pad.

17. A polishing method according to claim 16, further comprising a step of shifting the revolution axis to a predetermined position of the polished body in accordance with a surface configuration of the polished body.

18. A polishing method according to claim 16, further comprising a step of shifting the revolution axis of the polishing head to a predetermined position of the polished body in accordance with a surface configuration of the polished body, by rotation of the holding means and by shifting movement of the revolution axis.

19. A polishing method according to claim 16, wherein the distance between the revolution axis and the rotation axis is determined in accordance with a dimension of an element of an element substrate which is the polished body.

20. A polishing method according to claim 16, wherein the element substrate is a semi-conductor wafer, a glass substrate or a quartz substrate.

21. A polishing method according to claim 16, wherein the polished body is polished while supplying the abrasive agent from a small hole formed in the polishing head for holding the polishing pad.

22. A polishing method according to claim 16, wherein a supply tube connected to the small hole supplies the abrasive agent from the small hole to the polished body.

23. A polishing method according to claim 22, wherein the supply tube passes through the revolution axis.

24. A polishing apparatus comprising:

holding means for holding a polished body with a polished surface thereof facing upwardly; and a polishing head for holding a polishing pad having a polishing surface of an area smaller than an area of the polished surface to be contacted and for rotating said polishing pad around its rotation axis, wherein said polishing head is provided with drive means for revolving said polishing pad around a revolution axis, with the revolution axis and the rotation axis positioned so that a distance between the revolution axis and the rotation axis is smaller than a radius of said polishing pad, wherein said polishing head has a supply passage for supplying abrasive agent through said polishing pad, and said supply passage passes through the rotation axis, and a supply tube for supplying abrasive agent which is disposed within said supply passage is connected to an abrasive agent supplying source for supplying the abrasive agent via a rotary joint.

25. A polishing apparatus according to claim 24, wherein said supply tube passes through the revolution axis.

26. A polishing apparatus for polishing a surface of a wafer comprising:

a holder for holding the wafer with the surface thereof facing upwardly;

a polishing head for holding a polishing pad with a polishing surface of an area smaller than an area of the surface of the wafer and for rotating said polishing pad around its rotation axis; and a driver for revolving said polishing head so as to revolve said polishing pad around a revolution axis, wherein said revolution axis and said rotation axis are positioned so that a distance between said revolution axis and rotation axis is smaller than a radius of said polishing pad.

27. A polishing method for polishing a surface of a wafer by rotating a polishing pad having a polishing surface with an area smaller than an area of the surface of the wafer, said method comprising the steps of:

holding, on the holder, the wafer with the surface thereof facing upwardly;

arranging the polishing pad so that a distance between a revolution axis and a rotation axis is smaller than a radius of the polishing pad;

rotating the polishing pad around the rotation axis; and revolving the polishing pad around the revolution axis.

28. A polishing method according to claim 27, wherein the revolution axis of the polishing head can be shifted along the surface of the wafer.

29. A polishing method according to claim 27, further comprising a step of detecting a surface configuration of the wafer.

30. A polishing method according to claim 27, wherein a distance between the revolution axis and the rotation axis is variable.

31. A polishing method according to claim 27, further comprising a step of supplying abrasive agent through the polishing pad.

32. A polishing method according to claim 27, wherein the wafer has a semiconductor element.

33. A polishing method according to claim 27, wherein a desired part of the surface of the wafer is polished selectively or preferentially.

* * * * *

UNITED STATES PATENT AND TRADEMARK OFFICE

CERTIFICATE OF CORRECTION

PATENT NO. : 6,299,506 B1
DATED : October 9, 2001
INVENTOR(S) : Matsuomi Nishimura et al.

It is certified that error appears in the above-identified patent and that said Letters Patent is hereby corrected as shown below:

Column 7,
Line 62, "ration" should read -- ratio --.

Column 9,
Line 46, "claim 16," should read -- claim 21, --.

Signed and Sealed this

Fourteenth Day of May, 2002

*Attest:*

*Attesting Officer*

JAMES E. ROGAN
*Director of the United States Patent and Trademark Office*